United States Patent [19]

Hancox

[11] 4,228,721

[45] Oct. 21, 1980

[54] DRUM TUNING MECHANISM

[76] Inventor: Elwyn J. Hancox, 651 Muriel St., Winnipeg, Manitoba, Canada

[21] Appl. No.: 3,354

[22] Filed: Jan. 15, 1979

[51] Int. Cl.[3] ..... G10D 13/02

[52] U.S. Cl. ..... 84/411 R; 84/411 A; 84/413; 84/419

[58] Field of Search ..... 84/411–422

[56] References Cited

U.S. PATENT DOCUMENTS 586,503 7/1897 Lyon ..... 84/419
608,884 8/1898 Lyon ..... 84/419

FOREIGN PATENT DOCUMENTS 14412 9/1855 France ..... 84/419
923594 9/1947 France ..... 84/419

*Primary Examiner*—Lawrence R. Franklin
*Attorney, Agent, or Firm*—Stanley G. Ade

[57] ABSTRACT

One or more deadening elements are in contact with the underside of the drum head and are connected to a foot operated mechanism which moves the deadener or deadeners across the drum head thus varying the effective resonating area of the head so that the drum can be tuned while playing. As an example, the drum tuning can be changed from a bass drum to a concert tom. The preferred embodiment includes a pair of opposed, curved deadeners which are moved towards and away from one another in concentric relationship with the drum head.

19 Claims, 8 Drawing Figures

DRUM TUNING MECHANISM

BACKGROUND OF THE INVENTION

This invention relates to new and useful inprovements in tuning mechanisms for musical drums. Conventionally, such tuning is provided by the initial tightening of the skin constituting the drum head, by means of keys and adjustable bolts situated around the perimeter of the drum head.

Attempts have been made in the past to provide a tuning mechanism which is variable while the drum is being played and examples of such tuning mechanisms are shown in U.S. Pat. Nos. 2,729,133, 2,548,271, 3,685,389 and the mechanism shown in U.S. Pat. No. 4,048,895 which is an adaptation of the "RotoTom".

All of these patents operate by varying the tension in the drum head skin which is an unsatisfactory way of accomplishing the tuning because of the varying of tension of the skin. This tends to stretch the skin unduly and place undue strain upon the skin and considerable leverage is required in order to accomplish this skin or drum head stretching.

SUMMARY OF THE INVENTION

The present invention overcomes these disadvantages by accomplishing the tuning by varying the effective resonating area of the skin forming the drum head rather than by varying the basic tension thereof.

This means that the tension of the skin or drum head remains relatively constant at all times thus relieving undue strain upon the skin. It also means that relatively simple and lightweight mechanisms can be used to accomplish this variation of resonating area.

One aspect of the invention consists of a tuning mechanism for musical drums which include a substantially cylindrical body and a skin stretched over one end of the body and constituting a drum head; said tuning mechanism comprising in combination:

(a) at least one deadening element in contact with the underside of the drum head, (b) means mounting said deadening element within said body, (c) and means within said body operatively connected to said deadening element to move same across said drum head thereby varying the effective resonating area of said drum head, said deadening element including a pair of opposed strips. Each of said strips having one longitudinally extending surface contacting the underside of the drum head and at least one of the strips being movable towards and away from the other of said strips thereby defining the effective resonating area therebetween.

Another advantage of the present invention is that means may be provided to vary the initial contact or pressure of the deadeners upon the underside of the drum head.

A further advantage of the present invention is to provide a device of the character herewithin described in which the basic tuning of the drum head can be undertaken by the conventional means around the perimeter of the drum with the deadeners in the widest position thus enabling infinite tuning to be carried out from this point, within the range of the movement of the deadeners.

A still further advantage of the present invention is to provide a device of the character herewithin described which is preferably operated by a foot pedal attached to the drum thereby eliminating any tendency to lift the drum from the stand when the device is being operated.

Yet another advantage of the present invention is to provide a device of the character herewithin described which is simply installed upon existing drums, is economical in manufacture and otherwise well suited to the purpose for which it is designed.

While the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
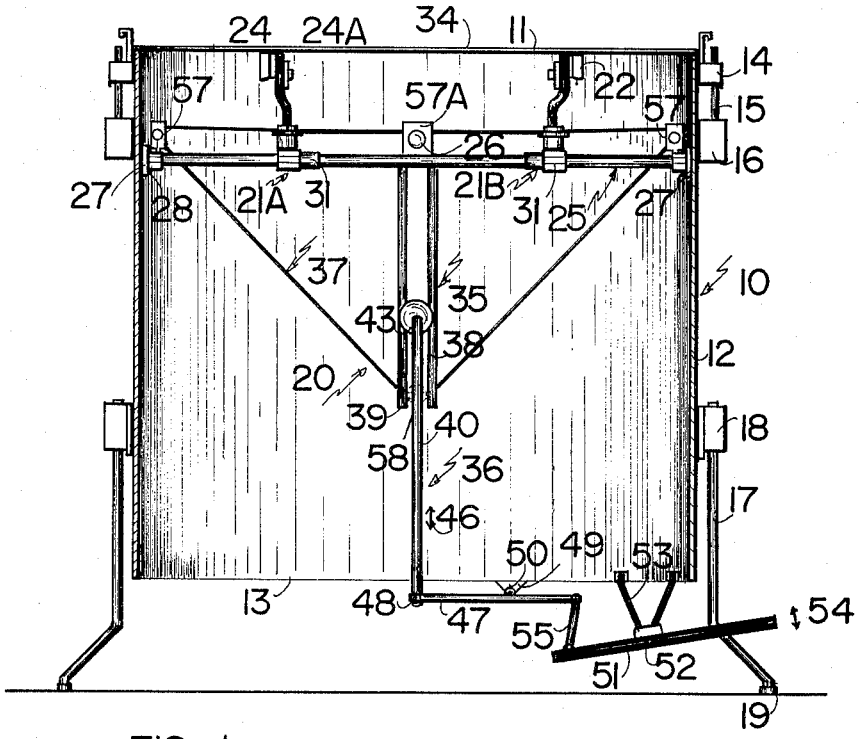
FIG. 1 is a vertical cross section of a musical drum showing the invention installed therein.
Figure 2:
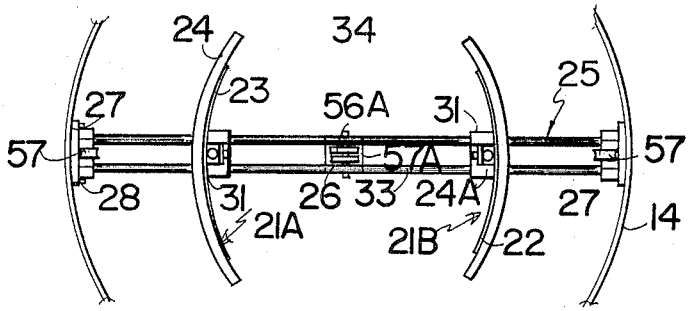
FIG. 2 is a fragmentary top plan view of the mechanism within the drum body with the drum head removed for clarity.

Before proceeding to describe the invention in detail, it will be observed that a drum collectively designated 10 is shown having a single skin 11 spanning the cylindrical body 12 at one end only with the opposite or lower end 13 being open and although the device is designed primarily for use with single headed drums, nevertheless it can be readily adapted for use with drums having opposing head assemblies.

The skin 11 is held by means of the clamp ring 14 surrounding the upper end of the drum body 12 and the initial tension of the skin is adjusted by a plurality of bolt assemblies 15 cooperating between the ring 14 and anchors 16 secured to the side wall of the drum, all of which is conventional.

Also to be noted are the tripod leg assemblies consisting of three individual leg members 17 engaging within leg holders 18 secured to the drum body 12 and extending downwardly therefrom terminating in rubber tipped lower ends 19, once again all of which is conventional.

The invention collectively designated 20 is situated within the drum body 12 and is secured thereto as will hereinafter be described.

In its preferred embodiment, the invention includes a pair of deadening elements collectively designated 21, although if desired, only one such element need be provided.

Each deadening element consists preferably of an arcuately curved member 22 secured to a mounting strip 23 by means of rivet screws or the like (not illustrated) with the mounting strip 23 in turn being secured to a cylindrical socket 24A as by welding or the like. The deadening members 22 are provided with a curvature similar to the curvature of the drum head and these elements are preferably formed from lead or a similar material and are positioned so that the upper longitudinally extending edge 24 contacts the underside of the skin 11 which constitutes the drum head. Lead or some similar substance is preferred as it gives the required deadening effect. Felt can be used, but it is found that felt gives a completely dead feeling whereas lead or some similar relatively heavy material, not only gives the required deadening effect, but also provides the desired amount of "hangover" when the drums are being played.

A rail assembly collectively designated 25 spans the body 12 of the drum just below the drum head or skin 11 and is preferably slightly arcuately curved with the apex 26 of the rail assembly being situated substantially centrally of the drum head 11.

In the present embodiment, the rail assembly comprises a pair of spaced and parallel cylindrical rods, the ends of which engage within sockets 27 which in turn are secured to the wall of the drum body 12 by means of screws 28 or the like.

The aforementioned deadener elements include a short angulated rod 29 engaging within the socket 24A so that the element 22 may be raised or lowered relative to the drum head 11 and secured in the desired relationship by means of a set screw or Allen screw 30 engaging through the wall of the socket 24A. This enables the edge 24 of the deadener element 22 to contact the underside of the head or skin 11 with the desired amount of pressure depending upon circumstances.

The lower end of the angulated rod 29 is screw threaded and engages within a mounting block 31 so that it extends upwardly from the upper side thereof. This mounting block is apertured as at 32 to slidably engage over the twin rails 33 constituting the part of the rail assembly 25 so that the two deadening assemblies can slide along the rails 33 towards or away from one another always maintaining contact with the underside of the drum head or skin 11.

It will be noted that the deadening elements are situated concentrically with the perimeter of the drum and one upon each side of the centre point of the drum head so that as they move towards or away from one another, they define therebetween, a resonating area indicated by reference character 34. The slight curvature of the rails is desirable as it assists in maintaining an even tension on the drum head or skin regardless of the position of the elements 21.

Means are provided to move the elements 21 towards or away from one another by the desired amount, said means including a guide track collectively designated 35 and an actuating rod collectively designated 36 with flexible cord assembly collectively designated 37 being operatively connected between the elements 21 and the actuating rod 36.

Figure 5:
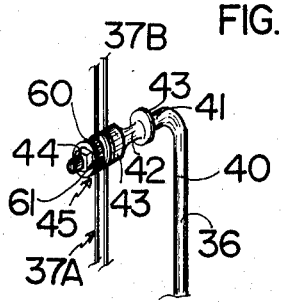
FIG. 5 is a fragmentary isometric view of the actuating rod per se.

The guide track 35, in this embodiment, includes a pair of spaced and parallel rods 38 extending downwardly from one of the tracks 33 approximately centrally thereof and having a lower bridging piece 39 providing stability. The actuating rod 36 is shown in detail in FIG. 5 and includes the main vertically extending portion 40 and the guide track engaging portion 41 extending at right angles from the upper end portion 40. A spool 42 is provided on the portion 41 having enlarged ends 43 which span the guide rods 38 on either side thereof and retain the spool between the rods so that it can be moved vertically along the guide track.

The distal end 44 of the portion 41 is screw threaded and includes a cord or cable anchoring portion collectively designated 45 which will hereinafter be described.

Reference to FIG. 1 will show that rod 36 may move in the direction of double-headed arrow 46 and one method of moving this rod upwardly or downwardly within the guide track, is shown schematically in FIG. 1. It will be appreciated that other linkage systems can be utilized, but in the present embodiment, a lever 47 is pivotally secured by one end thereof to the lower end of rod 36 by means of pivot pin 48 with the link 47 being in turn pivoted intermediate the ends thereof to a bracket 49 secured to the wall of the body 12 at the lower side thereof. Pivot pin 50 pivots the link 47 to bracket 49.

A foot pedal 51 is pivoted intermediate the ends thereof upon pivot pin 52 to a bracket assembly 53 also secured to the lower side of the drum body 12 and this foot pedal can be moved in the direction of double-headed arrow 54. A link 55 pivotally extends between one end of the foot pedal assembly and the other end of the link 47 so that movement of the foot pedal assembly moves the rod 36 upwardly or downwardly.

Figure 3:
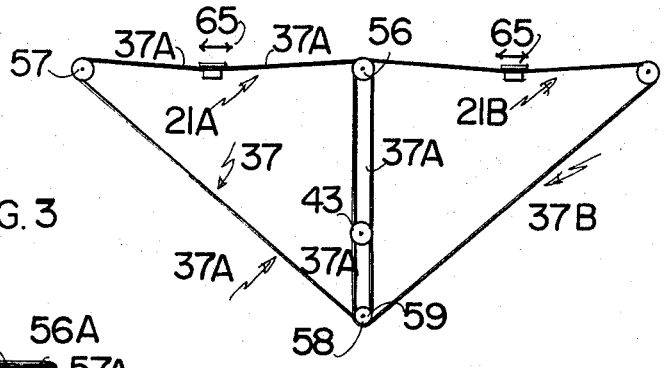
FIG. 3 is a schematic view of the preferred embodiment of the cable assembly per se.

The cord or cable assemblies 37 are operatively connected between the actuating rod 36 and the deadener elements 21 and FIG. 3 shows a schematic view of the preferred embodiment of these cable assemblies.

One cable assembly specifically designated 37A is provided for one of the deadener elements specifically designated 21A and a further cable assembly specifically designated 37B is provided for the other deadener assembly specifically designated 21B.

The two cord assemblies are similar and are distinguished in FIG. 3, by the prefixes "A" and "B".

Dealing first with the cord assembly 37A, one end of a length of cord is secured to the actuating rod 36 as will hereinafter be described, and extends upwardly from the end 41 of the rod, around a sheave 56 journalled within a sheave holder 57A secured adjacent the apex 26 of the track assembly 25. This cord specifically designated 37A then extends to the deadener element 22 and is secured thereto as will hereinafter be described. It then continues to a further sheave 57 mounted for rotation upon one of the brackets 27 and then downwardly to a sheave 58 journalled for rotation upon an offstanding pin 59 (see FIG. 4) secured to the lower end of the guide track 35. It then extends upwardly to be secured to the end 41 of the actuating rod 36 and upon the opposite side of this rod as shown in FIG. 3. The various cord portions therefore constitute a closed loop in effect with the actuating rod being secured in one position upon the loop and the deadener element 21 being secured in another position upon the loop spaced from the first position.

Figure 4:
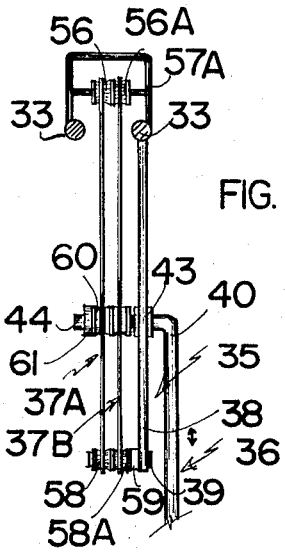
FIG. 4 is a fragmentary partially sectioned side elevation of the actuating mechanism.

The cord specifically designated 37B is an exact opposite of the previously described cord assembly with alternate sheaves being provided corresponding to the sheaves 56 and 58, as clearly illustrated in FIG. 4.

The cords are secured to the actuating rod portion 41 by extending through an aperture (not illustrated) formed through the rod portion and being clamped between a washer 60 and the spool end 43, by means of nut 61 engaging the screw threaded end 44.

Figure 6:
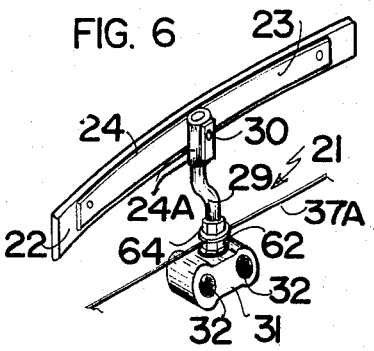
FIG. 6 is an isometric view of one of the deadeners and its attaching carriage.
Figure 7:
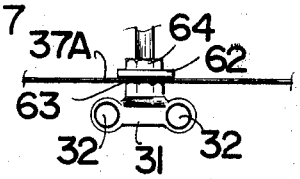
FIG. 7 is a front elevation of one of the attaching carriages per se.

The corresponding cords are clamped to the deadening elements 21 by extending through an aperture (not illustrated) formed through the stem 29 and being clamped between a washer 62 and a further washer 63 mounted upon the lower end of stem 29 and being clamped by means of nut 64 engaging the two washers. This detail is shown in FIGS. 6 and 7.

It will be seen that, regardless of the direction of movement of the actuating rod 36, the deadening elements 21 are always being pulled or are in tension as they move in either direction of double-headed arrow 65. It will be appreciated that other methods of movement of the deadeners can be utilized and operatively connected to the actuating rod 36 or its equivalent.

In operation, the deadening elements 21 are moved to their furthest apart position by moving the rod 36 to its uppermost location whereupon the initial tension drum head or skin 11 is set by means of the assemblies 15.

Once tuned to this basic tension, the tuning can be varied at will by moving the deadener elements 22 towards one another thereby varying the effective resonance area of the skin 11 and at the same time maintaining a substantially even tension to the skin or drum head 11.

Figure 8:
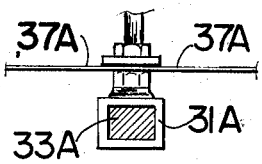
FIG. 8 is a view similar to FIG. 7 but showing an alternative embodiment.

Although the rail assembly 25 is shown with two cylindrical cross sectioned rods, nevertheless it will be appreciated that other configurations can be used provided that the deadening elements are prevented from rotating relative to the rail assembly. For example, in FIG. 8, a single rail 33A is illustrated having a square or rectangular cross section with the portion 31A having an aperture therethrough similar in configuration to the rail 33A so that it slides along the rail yet is prevented from rotating relative thereto.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention is:

1. A tuning mechanism for musical drums which include a substantially cylindrical body and a skin stretched over one end of the body and constituting a drum head; said tuning mechanism comprising in combination:

(a) at least one deadening element in contact with the underside of the drum head, (b) means mounting said deadening element within said body, (c) and means within said body operatively connected to said deadening element to move same across said drum head thereby varying the effective resonating area of said drum head, said deadening element including a pair of opposed strips each having one longitudinally extending surface contacting the underside of said drum head, at least one of said strips being movable towards and away from the other of said strips and defining the effective resonating area therebetween.

2. The tuning mechanism according to claim 1 in which at least one of said deadening elements includes an arcuately curved strip with one longitudinal surface thereof contacting the underside of said drum head.

3. The tuning mechanism according to claim 1 in which said means mounting at least one of said deadening elements within said body includes:

(a) a track assembly spanning said body, (b) and track assembly engaging means on said deadening element guiding and holding said deadening element relative to said drum head.

4. The tuning mechanism according to claim 2 in which said means mounting at least one of said deadening elements within said body includes:

(a) a track assembly spanning said body, (b) and track assembly engaging means on said deadening element guiding and holding said deadening element relative to said drum head.

5. The tuning mechanism according to claim 3 in which said track assembly is curved with the apex of the curvature being substantially centrally of said drum head.

6. The tuning mechanism according to claim 3 in which said means within said body operatively connected to said deadening element includes:

(a) a guide track mounted within said body, (b) an actuating rod, (c) means mounting said actuating rod for movement along said guide track, (d) cable means operatively connected between said actuating rod and said deadening element to pull said element along said track assembly, (e) and means to move said actuating rod along said guide track.

7. The tuning mechanism according to claim 4 in which said track assembly is curved with the apex of the curvature being substantially centrally of said drum head.

8. The tuning mechanism according to claim 4 in which said means within said body operatively connected to said deadening element includes:

(a) a guide track mounted within said body, (b) an actuating rod, (c) means mounting said actuating rod for movement along said guide track, (d) cable means operatively connected between said actuating rod and said deadening element to pull said element along said track assembly, (e) and means to move said actuating rod along said guide track.

9. The tuning mechanism according to claim 5 in which said means within said body operatively connected to said deadening element includes:

(a) a guide track mounted within said body, (b) an actuating rod, (c) means mounting said actuating rod for movement along said guide track, (d) cable means operatively connected between said actuating rod and said deadening element to pull said element along said track assembly.

10. The tuning mechanism according to claim 6 in which said cable means includes:

(a) a first cable portion secured by one end thereof to said actuating rod and extending in one direction therefrom, (b) sheaves mounted within said body around which said first cable portion extends, (c) said first cable portion being secured by the other end thereof to said deadening element and extending in one direction therefrom, (d) a second cable portion secured by one end thereof to said actuating rod and extending therefrom in a direction opposite to said first cable portion, (e) further sheaves mounted within said body around which said second cable portion extends, (f) said second cable portion secured by the other end thereof to said deadening element and extending therefrom in a direction opposite to the direction of said first cable portion.

(g) said first and second cable portions constituting a closed loop with said actuating rod being secured in one position on said loop and said deadening element being secured in another position on said loop spaced from said one position.

11. The tuning mechanism according to claim 7 in which said means within said body operatively connected to said deadening element includes:

(a) a guide track mounted within said body, (b) an actuating rod, (c) means mounting said actuating rod for movement along said guide track, (d) cable means operatively connected between said actuating rod and said deadening element to pull said element along said track assembly.

12. The tuning mechanism according to claim 8 in which said cable means includes:

(a) a first cable portion secured by one end therefrom, (b) sheaves mounted within said body around which said first cable portion extends, (c) said first cable portion being secured by the other end thereof to said deadening element and extending in one direction therefrom, (d) a second cable portion secured by one end thereof to said actuating rod and extending therefrom in a direction opposite to said first cable portion, (e) further sheaves mounted within said body around which said second cable portion extends, (f) said second cable portion secured by the other end thereof to said deadening element and extending therefrom in a direction opposite to the direction of said first cable portion, (g) said first and second cable portions constituting a closed loop with said actuating rod being secured in one position on said loop and said deadening element being secured in another position on said loop spaced from said one position.

13. The tuning mechanism according to claim 9 in which said cable means includes:

(a) a first cable portion secured by one end therefrom, (b) sheaves mounted within said body around which said first cable portion extends, (c) said first cable portion being secured by the other end thereof to said deadening element and extending in one direction therefrom, (d) a second cable portion secured by one end thereof to said actuating rod and extending therefrom in a direction opposite to said first cable portion, (e) further sheaves mounted within said body around which said second cable portion extends, (f) said second cable portion secured by the other end thereof to said deadening element and extending therefrom in a direction opposite to the direction of said first cable portion, (g) said first and second cable portions constituting a closed loop with said actuating rod being secured in one position on said loop and said deadening element being secured in another position on said loop spaced from said one position.

14. The tuning mechanism according to claim 11 in which said cable means includes:

(a) a first cable portion secured by one end therefrom, (b) sheaves mounted within said body around which said first cable portion extends, (c) said first cable portion being secured by the other end thereof to said deadening element and extending in one direction therefrom, (d) a second cable portion secured by one end thereof to said actuating rod and extending therefrom in a direction opposite to said first cable portion, (e) further sheaves mounted within said body around which said second cable portion extends, (f) said second cable portion secured by the other end thereof to said deadening element and extending therefrom in a direction opposite to the direction of said first cable portion, (g) said first and second cable portions constituting a closed loop with said actuating rod being secured in one position on said loop and said deadening element being secured in another position on said loop spaced from said one position.

15. The tuning mechanism according to claims 1, 2 or 3 which includes means to adjust the deadening element relative to said drum head thereby varying the pressure of said deadening element upon said drum head.

16. The tuning mechanism according to claims 4, 5 or 7 which includes means to adjust the deadening element relative to said drum head thereby varying the pressure of said deadening element upon said drum head.

17. The tuning mechanism according to claims 6, 8 or 9 which includes means to adjust the deadening element relative to said drum head thereby varying the pressure of said deadening element upon said drum head.

18. The tuning mechanism according to claims 10, 11 or 12 which includes means to adjust the deadening element relative to said drum head thereby varying the pressure of said deadening element upon said drum head.

19. The tuning mechanism according to claims 13 or 14 which includes means to adjust the deadening element relative to said drum head thereby varying the pressure of said deadening element upon said drum head.

* * * * *